US008950609B2

(12) United States Patent
Aneas

(10) Patent No.: US 8,950,609 B2
(45) **Date of Patent: *Feb. 10, 2015**

(54) DEVICE FOR STOPPING A CONTAINER, CONTAINER PROVIDED WITH SUCH A DEVICE, AND METHOD FOR CLOSING A BATCH OF SUCH CONTAINERS

(75) Inventor: Antoine Aneas, Menetrol (FR)

(73) Assignee: West Pharmaceutical Services Deutschland GmbH & Co. KG, Eschweiler (DE)

( * ) Notice: Subject to any disclaimer, the term of this patent is extended or adjusted under 35 U.S.C. 154(b) by 0 days.

This patent is subject to a terminal disclaimer.

(21) Appl. No.: 13/989,335

(22) PCT Filed: Nov. 23, 2011

(86) PCT No.: PCT/EP2011/070815

§ 371 (c)(1), (2), (4) Date: May 30, 2013

(87) PCT Pub. No.: WO2012/069538

PCT Pub. Date: May 31, 2012

(65) Prior Publication Data

US 2013/0240476 A1 Sep. 19, 2013

(30) Foreign Application Priority Data

Nov. 24, 2010 (FR) ..... 10 59682

(51) Int. Cl.
*B65D 41/58* (2006.01)
*B65D 39/00* (2006.01)
(Continued)

(52) U.S. Cl.
CPC ..... *B65D 51/18* (2013.01); *A61J 1/1412* (2013.01); *B65D 51/002* (2013.01);
(Continued)

(58) Field of Classification Search
CPC ..... B65B 1/04; B65D 39/00; B65D 41/58; B65D 51/18; A61J 1/2089
USPC ..... 215/251, 258, 272, 364, 249, 277, 307, 215/224, 311, 308; 34/296, 242, 287; 604/406, 415, 416, 414; 220/790, 320, 220/787; 53/485
See application file for complete search history.

(56) References Cited

U.S. PATENT DOCUMENTS 654,533 A * 7/1900 Garner ..... 215/277
809,213 A * 1/1906 Osgood ..... 215/251
(Continued)

FOREIGN PATENT DOCUMENTS

FR 2908396 A1 5/2008
FR 2927316 A1 * 8/2009 ..... B65D 51/24
(Continued)

OTHER PUBLICATIONS

International Search Report issued Jan. 19, 2012 in International Application No. PCT/USEP/070815.

*Primary Examiner* — Mickey Yu
*Assistant Examiner* — Gideon Weinerth
(74) *Attorney, Agent, or Firm* — Panitch Schwarze Belisario & Nadel LLP

(57) ABSTRACT

A stopper device including a stopper, cap and ring provided with tabs for locking onto a container neck and a body for handling the ring. The body includes a first mechanism for transmitting a thrust force to the ring and a second mechanism for activating the tabs. The ring and the handling body are respectively provided with first and second retainers that hold the handling body in a waiting position. The handling body is mobile parallel to the thrust force direction and in relation to the ring, between a first position activating the tabs of the ring and is mobile in translation only in the thrust force direction, and a second position that also activates the tabs and is immobilized in relation to the ring in axial translation. The tabs extend from a continuous edge of the ring and are each arranged in an opening with a closed contour.

11 Claims, 8 Drawing Sheets

(51) Int. Cl.

| | |
|---|---|
| ***B65D 51/18*** | (2006.01) |
| ***A61J 1/14*** | (2006.01) |
| ***B65D 51/00*** | (2006.01) |
| ***B65D 51/24*** | (2006.01) |
| ***B65B 7/28*** | (2006.01) |

(52) U.S. Cl.

CPC ..... *B65D 51/241* (2013.01); *B65B 7/28* (2013.01); *B65D 39/00* (2013.01); *A61J 1/1406* (2013.01); *A61J 2001/1425* (2013.01)

USPC ..... 215/247; 215/251; 215/250; 215/307; 215/277; 215/273; 215/364; 215/272; 220/790; 220/787; 220/320; 604/415; 34/284; 34/296; 34/287

(56) References Cited

U.S. PATENT DOCUMENTS

| | | | | |
|---|---|---|---|---|
| 3,587,899 | A * | 6/1971 | Bender | 215/307 |
| 3,834,571 | A * | 9/1974 | Bartell | 215/256 |
| 3,893,582 | A * | 7/1975 | Kowalik | 215/221 |
| 4,060,911 | A * | 12/1977 | Weiler et al. | 34/284 |
| 4,211,333 | A * | 7/1980 | Villarejos | 215/249 |
| 4,251,003 | A * | 2/1981 | Bodenmann | 215/254 |
| 4,359,166 | A * | 11/1982 | Dubach | 215/272 |
| 5,085,332 | A * | 2/1992 | Gettig et al. | 215/249 |
| 5,088,612 | A * | 2/1992 | Storar et al. | 215/247 |
| 5,269,429 | A * | 12/1993 | Schumacher | 215/249 |
| 5,303,835 | A * | 4/1994 | Haber et al. | 215/247 |
| 5,314,084 | A * | 5/1994 | Folta et al. | 215/249 |
| 5,316,163 | A * | 5/1994 | von Schuckmann | 215/249 |
| 5,421,469 | A * | 6/1995 | Lee | 215/274 |
| 5,602,530 | A * | 2/1997 | Holmgren | 340/572.1 |
| 5,678,718 | A * | 10/1997 | Morris et al. | 220/254.1 |
| 5,718,348 | A * | 2/1998 | Manera | 215/249 |
| 5,813,554 | A * | 9/1998 | Marangoni Graziani et al. | 215/274 |
| 5,819,964 | A * | 10/1998 | Grimard | 215/249 |
| 5,879,345 | A * | 3/1999 | Aneas | 604/411 |
| 5,890,610 | A * | 4/1999 | Jansen et al. | 215/253 |
| 5,957,314 | A * | 9/1999 | Nishida et al. | 215/249 |
| 5,992,660 | A * | 11/1999 | Miura et al. | 215/247 |
| 6,258,078 | B1 * | 7/2001 | Thilly | 604/411 |
| 6,604,643 | B1 * | 8/2003 | Michael et al. | 215/204 |
| 6,656,433 | B2 * | 12/2003 | Sasso | 422/569 |
| 7,451,899 | B2 * | 11/2008 | de Pous | 222/321.9 |
| 7,467,482 | B2 * | 12/2008 | Yarborough et al. | 34/287 |
| 7,570,161 | B2 * | 8/2009 | Necchi | 340/568.1 |
| 7,845,505 | B2 * | 12/2010 | Hamamoto et al. | 215/277 |
| 7,946,437 | B2 * | 5/2011 | Thilly et al. | 215/249 |
| 8,070,739 | B2 * | 12/2011 | Zinger et al. | 604/411 |
| 8,096,971 | B2 * | 1/2012 | Bassarab et al. | 604/84 |
| D655,017 | S * | 2/2012 | Mosler et al. | D24/231 |
| 8,225,949 | B2 * | 7/2012 | Aneas | 215/249 |
| 8,272,411 | B2 * | 9/2012 | Py | 141/301 |
| D681,230 | S * | 4/2013 | Mosler et al. | D24/231 |
| 8,544,665 | B2 * | 10/2013 | Bogle et al. | 215/224 |
| 8,562,582 | B2 * | 10/2013 | Tuckwell et al. | 604/406 |
| 8,608,723 | B2 * | 12/2013 | Lev et al. | 604/414 |
| 8,684,204 | B2 * | 4/2014 | Belle | 215/274 |
| 8,684,225 | B2 * | 4/2014 | Gelibert et al. | 220/790 |
| 8,752,598 | B2 * | 6/2014 | Denenburg et al. | 141/329 |
| 2001/0008962 | A1 * | 7/2001 | Forsberg et al. | 604/232 |
| 2002/0023409 | A1 * | 2/2002 | Py | 53/426 |
| 2002/0183714 | A1 * | 12/2002 | Antoine | 604/414 |
| 2003/0010668 | A1 * | 1/2003 | Taskis et al. | 206/528 |
| 2003/0102279 | A1 * | 6/2003 | Michael et al. | 215/204 |
| 2003/0107628 | A1 * | 6/2003 | Fowles et al. | 347/86 |
| 2005/0086830 | A1 * | 4/2005 | Zukor et al. | 34/443 |
| 2006/0273115 | A1 * | 12/2006 | De Pous | 222/321.9 |
| 2006/0287638 | A1 * | 12/2006 | Aneas | 604/411 |
| 2007/0181449 | A1 * | 8/2007 | Hamamoto et al. | 206/219 |
| 2007/0272648 | A1 * | 11/2007 | Hamamoto et al. | 215/277 |
| 2009/0001042 | A1 * | 1/2009 | Sever et al. | 215/248 |
| 2009/0036866 | A1 * | 2/2009 | Moy et al. | 604/416 |
| 2009/0177177 | A1 * | 7/2009 | Zinger et al. | 604/414 |
| 2010/0012615 | A1 * | 1/2010 | Brooks | 215/256 |
| 2010/0050575 | A1 * | 3/2010 | Aneas | 53/485 |
| 2010/0089862 | A1 * | 4/2010 | Schmitt | 215/249 |
| 2010/0168712 | A1 * | 7/2010 | Tuckwell et al. | 604/406 |
| 2010/0179506 | A1 * | 7/2010 | Shemesh et al. | 604/414 |
| 2010/0224632 | A1 * | 9/2010 | Aneas | 220/315 |
| 2010/0243599 | A1 * | 9/2010 | Chae | 215/274 |
| 2011/0068106 | A1 * | 3/2011 | Zukor et al. | 220/367.1 |
| 2011/0186451 | A1 * | 8/2011 | Dersjo et al. | 206/219 |
| 2011/0266249 | A1 * | 11/2011 | Kakutani et al. | 215/364 |
| 2012/0061422 | A1 * | 3/2012 | Beranger et al. | 222/321.1 |
| 2012/0187072 | A1 * | 7/2012 | Belle | 215/274 |
| 2012/0248057 | A1 * | 10/2012 | Bogle et al. | 215/43 |
| 2012/0296307 | A1 * | 11/2012 | Holt et al. | 604/407 |
| 2013/0055681 | A1 * | 3/2013 | Vrijens et al. | 53/440 |
| 2013/0199669 | A1 * | 8/2013 | Moy et al. | 141/386 |
| 2013/0204222 | A1 * | 8/2013 | Moy et al. | 604/416 |
| 2013/0233822 | A1 * | 9/2013 | Aneas | 215/317 |
| 2013/0312373 | A1 * | 11/2013 | Bogle et al. | 53/485 |
| 2014/0096862 | A1 * | 4/2014 | Aneas | 141/1 |
| 2014/0209603 | A1 * | 7/2014 | Aneas | 220/257.1 |
| 2014/0217099 | A1 * | 8/2014 | Browne | 220/259.1 |

FOREIGN PATENT DOCUMENTS

| | | | | |
|---|---|---|---|---|
| FR | 2967655 | * | 11/2010 | B65D 51/00 |
| FR | 2976265 | A1 * | 12/2012 | |
| WO | 2007063218 | A1 | 6/2007 | |
| WO | 2008129144 | A1 | 10/2008 | |
| WO | WO 2009101354 | A1 * | 8/2009 | |

* cited by examiner

DEVICE FOR STOPPING A CONTAINER, CONTAINER PROVIDED WITH SUCH A DEVICE, AND METHOD FOR CLOSING A BATCH OF SUCH CONTAINERS

CROSS-REFERENCE TO RELATED APPLICATIONS

This application is a Section 371 of International Application No. PCT/EP2011/070815, filed Nov. 23, 2011, which was published in the French language on May 31, 2012, under International Publication No. WO 2012/069538 A1 and the disclosure of which is incorporated herein by reference.

BACKGROUND OF THE INVENTION

The invention relates to a stopping device for a container equipped with a neck, as well as to a container provided with such a device. The invention also relates to a method for closing a batch of containers provided with a stopping device.

In the field of containers for medication, it is common to use a glass vial to preserve an active medicament in the form of lyophilizate, power or liquid solution. Such a vial must be closed in a dry manner in order to maintain its content in a satisfactory preserving state, until the date it is used. In order to hermetically seal a vial, it is common to use a stopping device that consists of a elastomer stopper and plastic cap intended to be fixedly attachable around the stopper to isolate the exterior.

WO-A-2007/063218 offers a stopping device, the cap of which consists of a ring and a body that allows maneuvering the locking means of the ring on the neck of a container. Moreover, WO-A-2008/129144 is known to integrate a deformable transmission element with thrust force into a stopping device which is intended to fade when a thrust force has been sufficiently transmitted to bring a body into a position where it activates the locking means of a cap on the neck of a container. FR-A-2-927-316 discloses the use of a connecting web which connects a peripheral press rim to a central stud and which has a different stiffness over different deformation ranges. FR-A-2 908 396 offers a stopping device in which a ring has a curbed extremity towards the exterior and cooperates with an internal peripheral groove of a ring to maintain locking means in an fixed position of the stopping device. These known devices offer overall satisfaction, particularly when they are used on vials, of which the neck has a diameter of 20 mm.

When these stopping devices are used to seal vials that belong to a batch of vials installed within a freeze-drier, by exercising a thrust force divided over the different stopping devices to bring them into a closed configuration, the thrust force exercised by means of a common body called "pressure plate" is divided over the different stopping devices. When containers with a relatively small diameter, particularly containers with a neck of a diameter of 13 mm, are used it is economically desirable to install a batch of containers previously equipped with stopping devices in a freeze-drier with the largest number of containers possible. In this case, the combined thrust force that is exercised by the pressure plate on each stopping device has a relatively weak intensity, equal to 25 Newtons for a classic freeze-drier. Under these conditions, it is important to minimize the necessary force to bring each stopping device into its usable configuration where it efficiently closes the neck of a container.

The present invention is directed to this problem by offering a stopping device in which the necessary force to bring the device into a usable configuration is minimized.

In this regard, the invention relates to a stopping device of a container provided with a neck, whereby this device contains a stopper and plastic cap, suitable for covering both the neck and the stopper in place on the neck, whereby this cap consists of a ring, suitable for surrounding the stopper and the neck in mounted configuration and provided with locking means on the neck, as well as a handling body of the ring, suitable to be mounted on the ring and provided with a thrust transmitting means for transmission to the ring a thrust force and a locking activation means for activating the locking means of the ring, while the ring and handling body, respectively, are provided with ring retainers and a holding position retaining means that cooperate together to maintain the handling body in a holding position in relation to the ring, where the handling body does not activate the locking means of the ring. In conformity with the invention, in a first position relative to the ring, the handling body is mobile in translation only in the direction of the thrust force, and a second position where the handling body activates the locking means of the ring and where the handling body is immobilized in relation to the ring in axial translation, according to a direction that is parallel to the thrust force, while the handling body comprises a first cylindrical surface with a constant radius or in the shape of an outwardly-inclined, radially inwardly-facing surface arranged facing the ring retainers of the ring, on the course of travel of the handling body between its first and second positions, and a second cylindrical surface with a constant radius or in the shape of an outwardly-inclined, radially inwardly-facing surface arranged facing the locking means of the ring, on the course of travel of the handling body between its first and second positions. Additionally, the locking means of the ring comprise locking tabs that extend from a first continuous edge of this ring, in the direction of the second edge of the ring opposite its first edge, while the diameter of a circle that circumscribes the external radial parts of the locking tabs has a greater value than the external diameter of the first edge and that each tab is arranged in an opening with closed contour which crosses the ring according to a radial direction in relation to a longitudinal and central axis of this ring.

BRIEF SUMMARY OF THE INVENTION

The handling body can be brought from its holding position to its first position where it ensures, through its action with the locking means, the attachment of the device on the container. Then, the two cylindrical surfaces with a constant radius or in the shape of an outwardly-inclined, radially inwardly-facing surface allow for the frictions to be limited between the handling body and the ring during the movement of the handling body between its first and its second position. This results in the fact that the necessary force to bring the handling body from its first to the second position is of limited intensity, and allows for a large number of stopping devices to be acted on simultaneously or to run a control operation based on a calibrated force allowing the handling body to pass from the first to the second position. In addition, the positioning of the locking tabs in the openings with closed contour and the fact that the edge of the ring is continuous gives a certain flexibility to the tabs that is sufficient to fulfill their function, while the ring is resistant, mechanically speaking.

According to the advantageous but non-obligatory aspects of the invention, such a device can incorporate one or several of the following characteristics taken in any combination that is technically acceptable:

The handling body comprises a buttress that prevents the handling body from traveling in relation to the ring, from the first position and extending to the second position, by cooperating with the ring retainers provided on the ring.

The handling body comprises an annular skirt and the first and second surfaces, as well as possibly the buttress mentioned above, are arranged on an internal surface of this skirt.

The locking means, on the one hand, and the handling body, on the other hand, are respectively provided with first and second immobilizing means that cooperate together in order to immobilize the handling body in translation in relation to the ring in the second position. In this case, the first immobilizing means preferably comprises at least a protrusion arranged on an external radial side of a tab, while the second immobilizing means comprises at least a groove receiving and retaining the protrusion when the handling body is in its second position.

The ring retainers are arranged on deformable bands that extend, according to a direction that is parallel to the thrust force, between an annular part of the ring intended to support on an exposed side of the stopper and annular edge of the ring from which the locking means extend.

A lid is connected with the ring and it isolates a central opening of the ring from the exterior that gives access to an exposed surface of the stopper, while the handling body consists of an annular skirt that surrounds the stopper, except at the level of a notch arranged in a higher edge of the skirt opposite the container in a mounted configuration of the device and when a radial clearance is arranged between the lid and the higher edge of the skirt, at least adjacent to a zone of the skirt diametrically opposite the notch.

The handling body consists of an annular skirt with a circular section that radially surrounds the ring when the handling body is in the holding position and in the first and second positions, while the exterior diameter of the skirt is less than 16.5 mm, and preferably between 15.8 mm and 16.2 mm.

The invention also relates to a container equipped with a stopping device as mentioned above.

To conclude, the invention relates to a method for closing a batch of containers as mentioned above, whereby this method consists of the following phases:

a) pre-assembling each stopping device with its stopper and its cap in a holding position, b) pre-mounting the devices on the necks of containers by inserting their stoppers in these necks, c) applying, by means of a pressure body, a common thrust force on all of the devices, in such a way as to completely insert the stoppers in the necks and to bring the handling body of each stopping device in its first position, in its second position or in an intermediary position between these first and second positions, d) individually applying on each handling body of the stopping devices, a thrust force calibrated in a direction of travel of the handling body from its first position towards its second position, e) determining if the handling body has reached its second position at the end of phase d), and f) if the result of the phase e) is negative, identifying the stopping device as incorrectly mounted on the corresponding container.

BRIEF DESCRIPTION OF THE SEVERAL VIEWS OF THE DRAWINGS

The invention will be better understood and other advantages of this invention will appear more clearly in the light of the description that will follow an embodiment of a stopping device, of a container and of a method in conformity with its principle, given uniquely by way of example and done with reference to the annexed drawings in which.

DETAILED DESCRIPTION OF THE INVENTION

FIGS. 1 to 5 represent different phases of packaging of a product P in glass vials 1 that constitute the containers.

Figure 1:
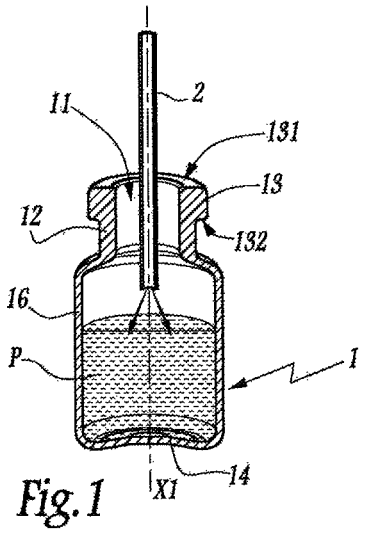
FIGS. 1 to 5 represent schematically, in an axial view and in perspective, several phases of packaging a product in the containers in conformity with the invention.
Figure 2:
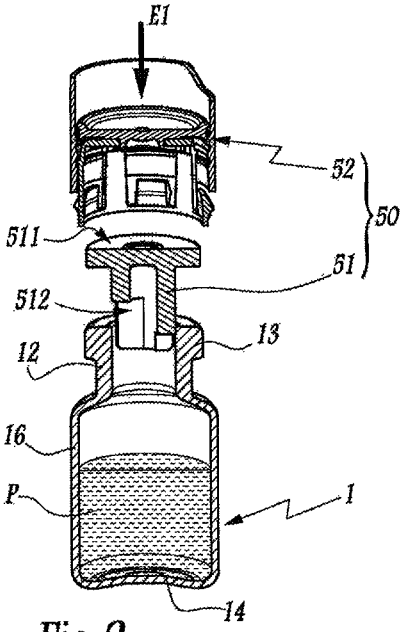

In FIG. 1, a vial 1 is in the process of being filled with a product P, for instance a medicine. A pipette 2 is introduced in a vial 1 through an opening 11 which is defined by a neck 12 that presents an external ring 13. X1 is marked as the symmetry axis of vial 1.

When a predetermined amount of the product P has been introduced in the vial 1, the pipette 2 is removed and a stopping device 50 is placed on neck 12.

A device 50 comprising an elastomer stopper 51 in adapted form to be partially introduced in the opening 11, by resting completely on a side 131 of the neck ring 13 opposite the bottom 14 of the vial 1. Once it is in place in the neck 12, the stopper 51 separates the content of the vial 1 from the exterior.

The device 50 also comprising a cap 52 intended to cover and isolate the stopper 51 and the neck 12 in a closed configuration of the stopping device 50.

As it is evident from FIGS. 7 to 10 in particular, the cap 52 has a plastic ring 53, which has an interior circular section with an internal diameter sufficient to allow it to surround neck ring 13.

The cap 52 also has a plastic crown (or handling body) 54 which is intended to form the external peripheral cover of the cap 52. Additionally, the cap 52 also has a lid 56 that is also made out of plastic. This lid 56 is completely in rotational symmetry about a central axis X56.

The lower edge 541 of the crown 54 is oriented towards vial 1 in an installed configuration of the cap 52 on the vial. The edge 541 can be described as being "lower" to the extent that it is oriented towards the bottom in the configuration of FIGS. 2 to 5. In this description, the spatial orientation of the different elements mentioned is considered in the case where the device 50 is mounted on a vial 1 that rests on a flat surface by its bottom 14. A part is said to be "lower" when it is oriented towards the bottom in this configuration and is said to be "higher" when it is oriented towards the top.

Top edge 542 of crown 54, which is opposite the lower edge 541, is provided with a notch 543. With the exception of this notch, crown 54 is in rotational symmetry about an axis X54.

The ring 53 is centered on an axis X53 which is aligned with the axes X54 and X56 in the assembled configuration of cap 52, whereby this axis is concentric with a central axis X52 of cap 52.

The ring 53 consists of an annular part 531 that defines a central opening 532 through which it is possible to access the top surface 511 of the stopper 51 if need be.

The internal surface 561 of the lid 56 faces the stopper 51 in the mounted configuration of the device 50 on vial 1. The lid 56 is provided with a skirt 562 centered on the axis X56 and which extends parallel to this axis from the surface 561.

During the manufacturing of the cap 52, the lid 56 is placed on the ring 53 by bringing the internal surface 561 of the lid 56 adjacent the annular part 531 of the ring 53, by introducing the skirt 562 of the lid 56 in the opening 532 in the annular part 531 and by attaching the lid 56 to the annular part 531 by fusing thereto the four platforms 563 arranged, for that purpose, on the surface 561 and equally distributed around the skirt 562.

When the lid 56 has been fixed on the ring 53, the crown 54 is engaged around elements 53 and 56 in such a way that it demarcates the maximum radial girth of the cap 52 in relation to axis X52.

In practice, the geometry of the pieces 53, 54 and 56 is chosen in such a way that the maximum external diameter D54 of crown 54 has a value lower than 16.5 mm, preferably between 15.8 and 16.2 mm, yet more preferably equal to 16 mm.

Under these conditions, when a vial 1 having a body 16 with a diameter that is equal to 16 mm is used, which is common for certain medications, the cap 52 mounted on the vial 1 does not pass or only passes the body of the vial 1 a little bit, in a radial direction in relation to axis X1. This allows for vials 1, which are previously equipped with a stopping device 50, to be placed on a shelf of a freeze-drier with high density, resulting from the relatively small diameter of the bodies of these vials without the risk that the vials are destabilized by the stopping devices they support.

The ring 53 comprises five bands 533 that extend from the annular part 531 until a lower edge of the ring 53 which is formed by a continuous ring 534 around the axis X53. The external radial edge 5311 of the annular part 531 defines a second edge or top edge of ring 53 and the bands 533 extend between the edges 534 and 5311.

Each band 533 is provided with an external rib 535 that juts out radially towards the exterior in relation to the axis X53 in relation to this band. A window 536, i.e. a open zone with closed contour that puts the interior volume of ring 53 and the exterior in contact, is defined between each pair of two adjacent bands 533.

A locking tab 537 extends from the continuous ring 534 in each window 536. Taking into account the intrinsic flexibility of the material that makes up the ring 53, each tab 537 can pivot around its base in relation to the edge of the continuous ring 534. In other words, each tab 537 can be more or less displaced towards the interior of the ring 53 in response to an applied force.

The tab 537 has a free edge 5371. A top external peripheral surface 5372 adjoins the free edge 5371 and extends at an angle relative to the axis X53 radially outwardly terminating in a protrusion 5374 having a generally arcuate shape with a terminus forming a shoulder 5375. A lower external peripheral surface 5373 extends from the shoulder 5375 at an angle relative to the axis X53 radially inwardly terminating at the edge of the continuous ring 534.

The edge of the continuous ring 534 has an exterior diameter D534. An imaginary circle C537 having a diameter D537 is centered on axis X53 and passes by the radially outwardly extending protrusion 5374. In a non-tight position of locking tabs 537, the value of the diameter D537 is larger than that of the diameter D534, by at least 1.5 mm. Even when the crown 54 surrounds the locking tabs 537, as envisioned above, the diameter D537 has a value that is larger than diameter D534, whereby the difference between these values is less than when the locking tabs 537 are in the non-tight position.

The ring 53 on the interior of the junction zone between the band 533 and the annular part 531 is provided with ribs 562 intended to superficially penetrate in the stopper 51 in order to immobilize this stopper in the ring 53 and in the cap 52.

Essentially, the crown 54 consists of a skirt 544 that extends between the edges 541 and 542, and is a circular cylindrical having an external radial surface 545 and an internal radial surface 546.

The internal radial surface 546 is provided with a rib 5461 that extends in the direction of the axis X54 and which is demarcated by a top surface 5462 perpendicular to the axis X54 and an lower surface 5463 converging in the direction of the edge 541.

Figure 3:
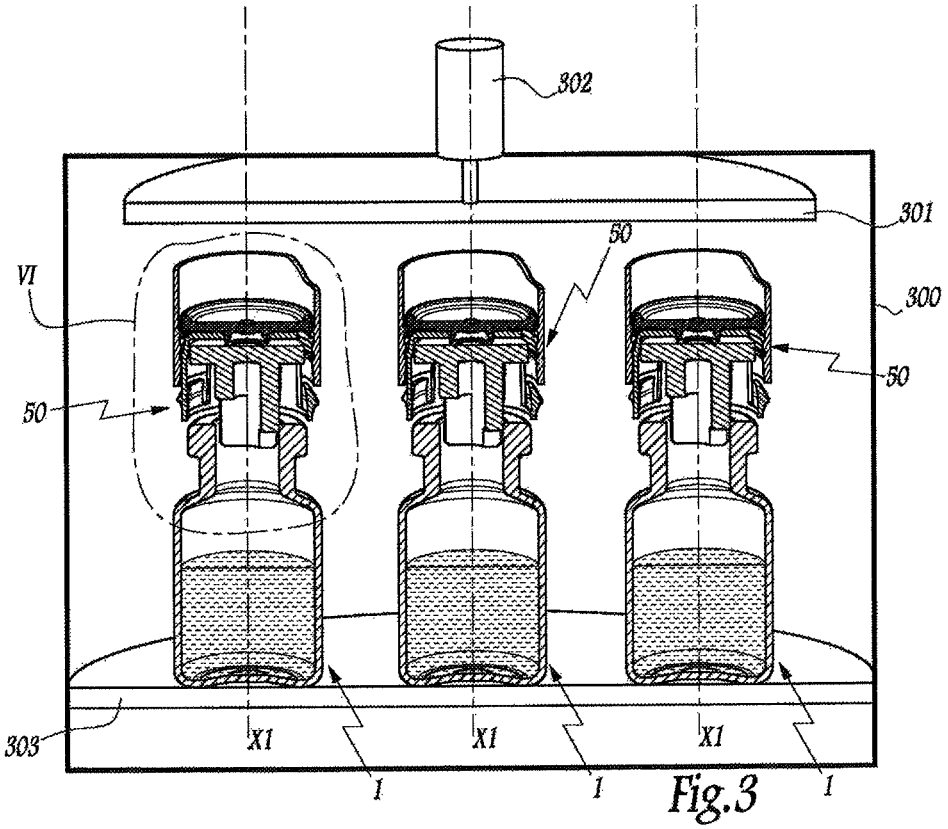
Figure 6:
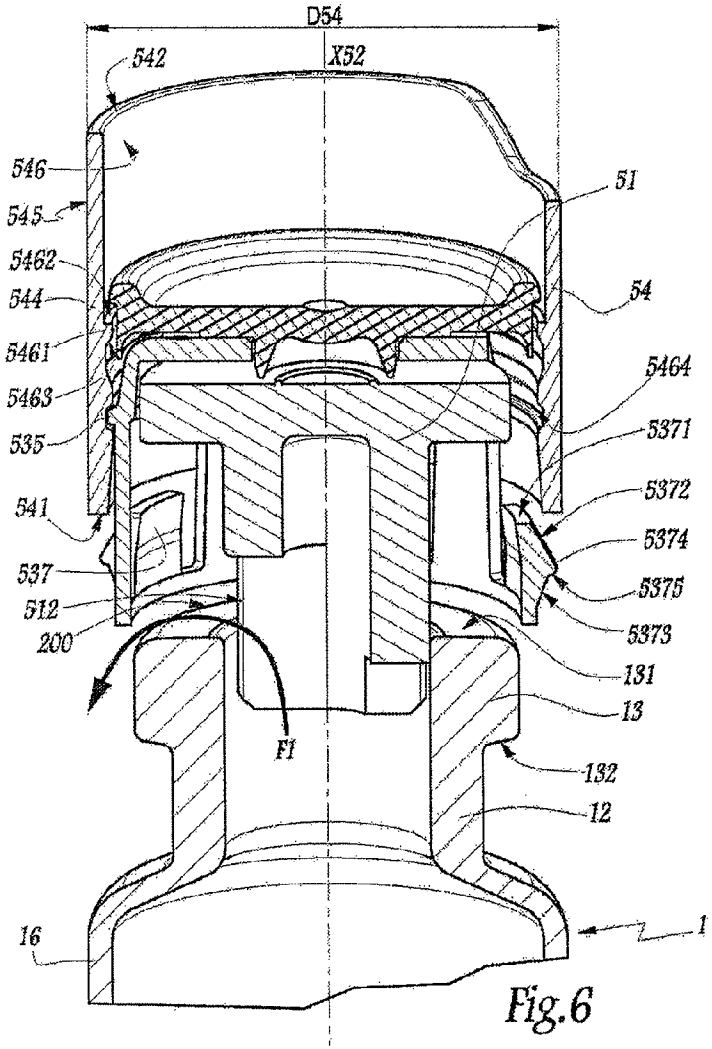
FIG. 6 is a view at a much larger scale of detail VI in FIG. 3.
Figure 7:
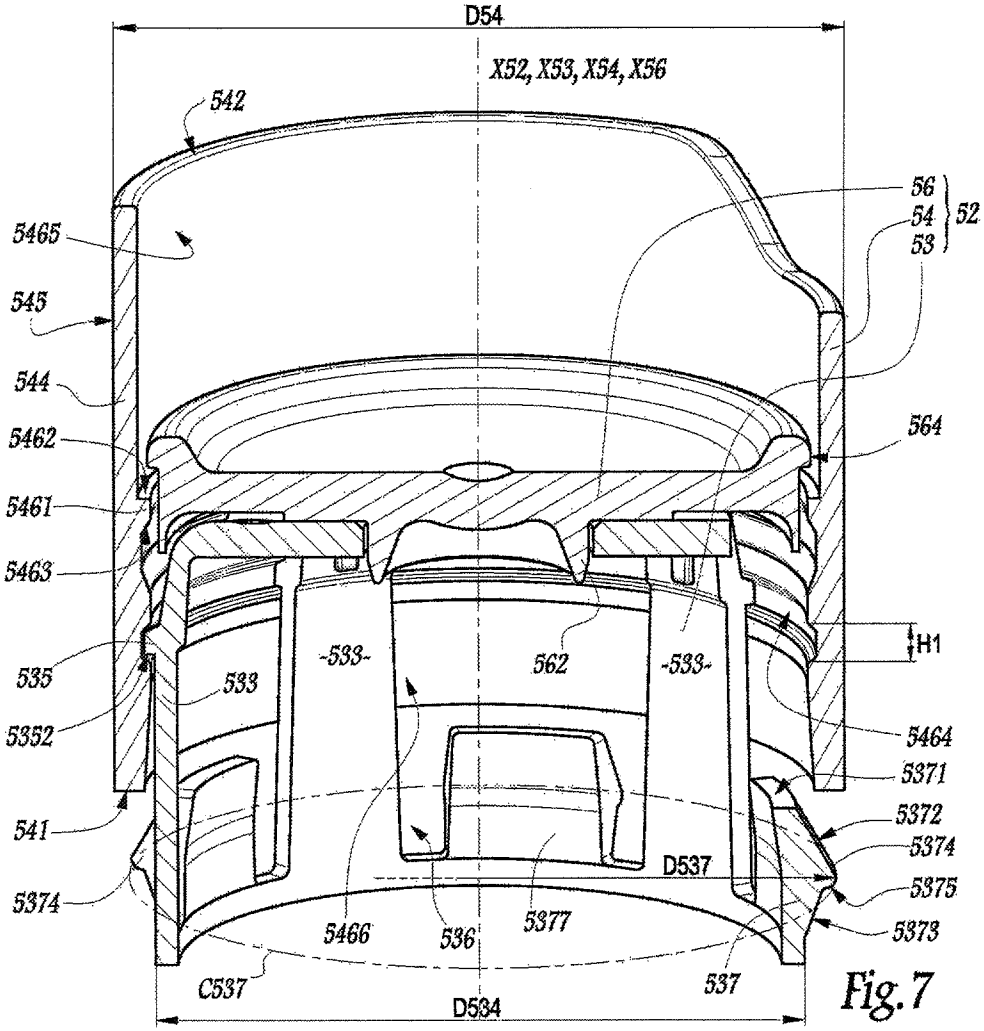
FIG. 7 is an axial view, in perspective and at a much larger scale, of the cap of stopping devices of containers of FIGS. 1 to 5.

The surface 546 is also provided with a peripheral groove 5464, the height H1 of which is measured parallel to the axis X54 is sufficient to receive the ribs 535 of the bands 533 in a configuration where the crown 54 is in a holding position in relation to the ring 53. This configuration is represented in FIGS. 3, 6 and 7.

The surface 546 also consists of a first cylindrical surface 5465 having a constant radius that extends between the rib 5461 and the edge 542 and a second surface 5466 in the shape of an outwardly-inclined, radially-inwardly facing surface, splitting in the direction of the edge 541 and which extends between the groove 5464 and the edge 541. The surfaces 5465 and 5466 are centered on the axis X53.

The angle of the surface 5466 relative to the axis X53 is less than 10°, preferably equal to 7°.

When the lid 56 has been fused on the ring 53, as explained above, the crown 54 is engaged around the elements 53 and 56 due to a pre-assembly axial force E1, i.e. parallel to axes X52, X53, X54 and X56 which are then coincident. This results in the fact that the skirt 544 is brought around the bands 533. This movement continues until the ribs 535 move into the groove 5464 and are locked therein. The sliding of the crown 54 in relation to ring 53 takes place due to the elasticity of the bands 533 that can elastically deform when their respective ribs 535 slid along the surface 5466 of the crown 54, prior to moving into the groove 5464. In other words, the geometry of the ring 53 gives the bands 533 a sufficient flexibility so that the placement of the crown 54 around the elements 53 and 56 is easy. In practice, the circumferential width of the bands 533 extend each, in relation to the axis X53 on an angular sector at an angle at the top less than 30°, preferably 25°.

When the cap 52 has been pre-assembled, it is possible to put the stopper 51 in it by introducing it on the inside of the ring 53 until the ribs 562 superficially penetrate in the stopper 51, which assures that the stopper remains in the ring. Alternatively, the stopper 51 can be placed on the neck 12 of the vial 1, as presented in FIG. 3 before the cap 52 is placed on the stopper. In all cases, we achieve the configuration of FIG. 3 in which the stopper 51 does not completely cover the opening 11 in the neck 12 since this stopper is provided with a lateral cut 512 that arranges an interstice 200 at the level of part of the top side 131 of the neck ring 13.

Figure 4:
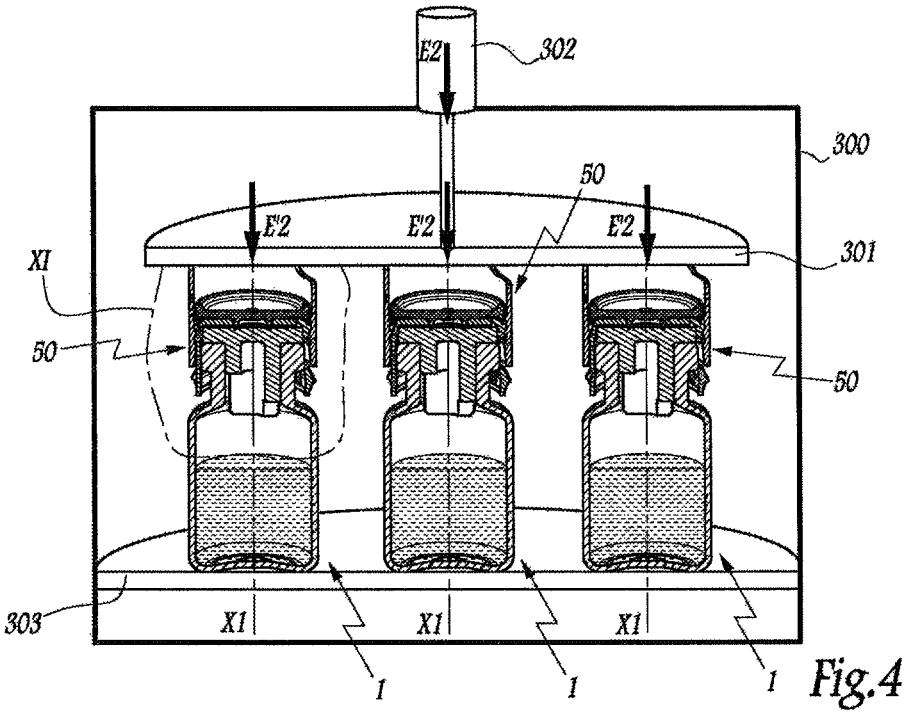
Figure 5:
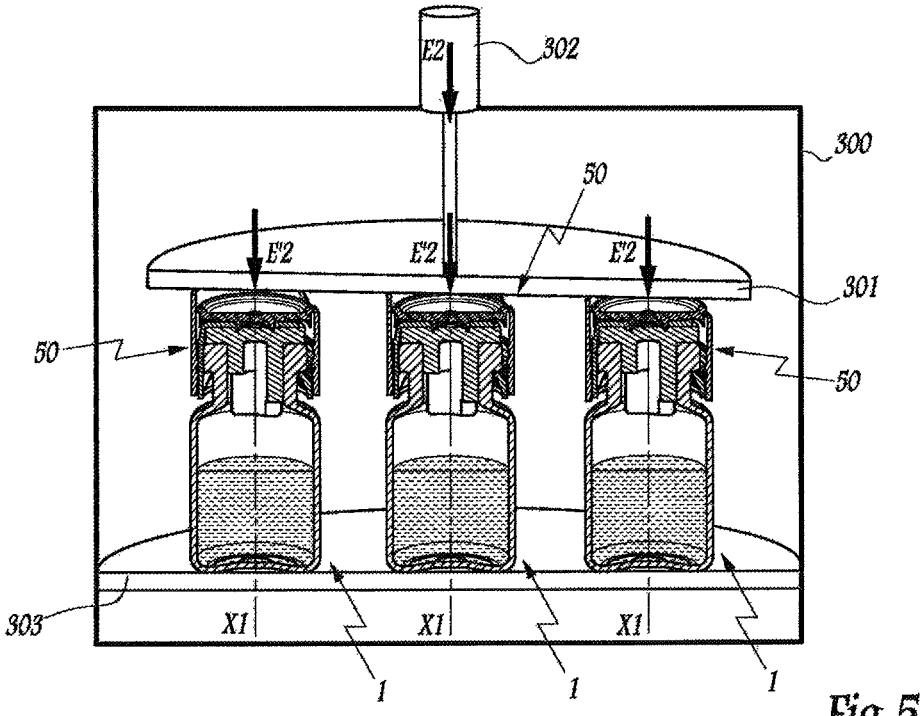

Equipped vial 1 of device 50 can thus be introduced in a freeze-drier 300 within a batch of vials 1. In FIGS. 3 to 5, three vials represent a batch that can consist of several hundred, in fact several thousand vials placed in freeze-drier 300. Additionally, the vials can be placed in this freeze-drier on several platforms placed on top. In this freeze-drier, the water molecules that are present in each vial 1 are evacuated towards the exterior, as presented by arrow F1 in FIGS. 3 and 6, through the interstices that remain between the cap 52 and the neck ring 13.

On the inside of a freeze-drier, as presented in FIG. 4, it is then possible to apply a thrust force E2 on the devices 50 parallel to the longitudinal axis X1 of the vials 1 and the neck rings 11, the axis with which the axes X52 of different caps 52 are coincident. This axial force E2 is applied by a mobile plate 301 on the inside of the freeze-drier and commanded by an actuator 302. At the same time, the plate 301 sensibly applies the same joint force E'2 on the cap 52 of each vial 1 of a row of vials placed at the same level, on the same platform 303 in the freeze-drier.

The sum of forces E'2 is equal to the force E2.

Figure 11:
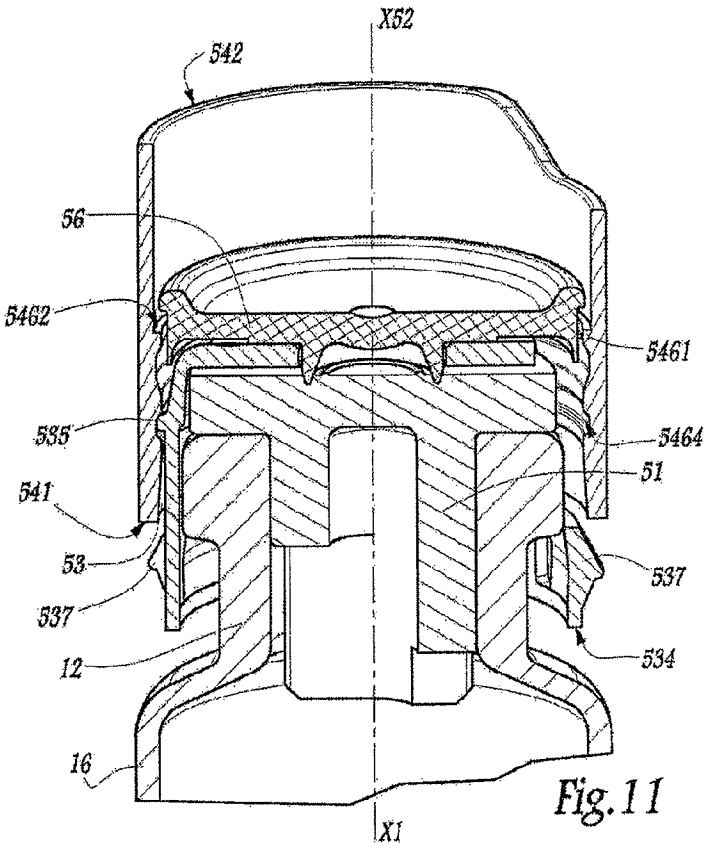
FIG. 11 is a view at a much larger scale of detail XI in FIG. 4, whereby the pressure plate is omitted for the sake of clarity of the drawing.

In the configuration of FIGS. 4 and 11, the crown 54 is in a holding configuration to the extent that it does no longer interact with locking tabs 537.

The application of force E2 results in the progression of the crown 54 of each cap 52 in the direction of the bottom 14 of each of vials 1, as presented by the passage from the configuration of FIGS. 3 and 6 to that of FIGS. 4 and 11. Force E'2 is transmitted from the crown 54 to the ring 53 by means of the groove 5464 and the ribs 535 that cooperate. Thus, the force E'2 applied on each device 50 results in bringing the tabs 537 of its ring 53 between the neck ring 13 and the body 16 of the vial, around the part of the neck 12 not provided with the neck ring 13.

Figure 13:
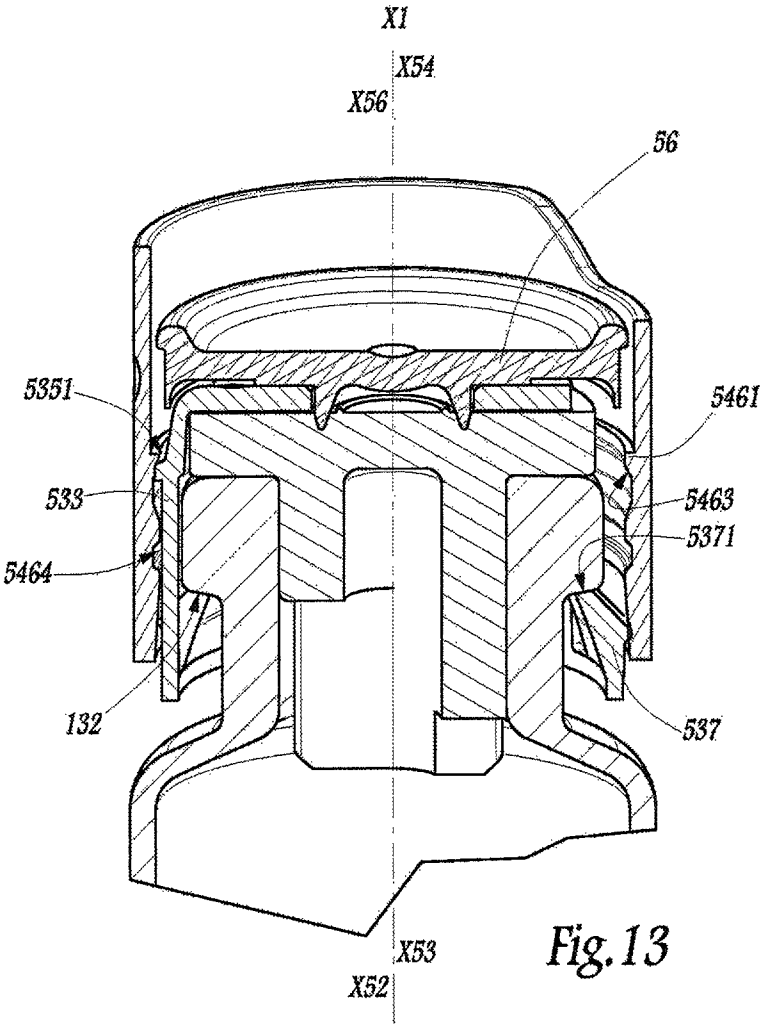
FIGS. 12 to 15 are views analog to FIG. 11 during the later phases of a closing method in conformity with the invention.
Figure 15:
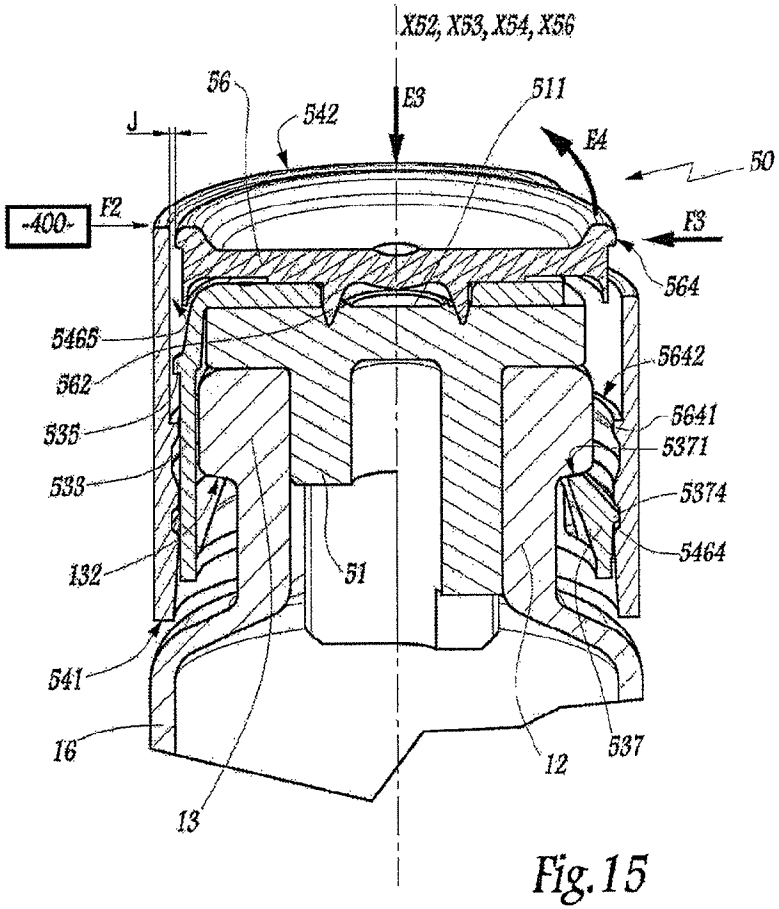

The outwardly-inclined, radially inwardly facing surface 5466 progressively deflects the locking tabs 537 from the position of FIG. 13 to that of FIG. 15.

Figure 12:
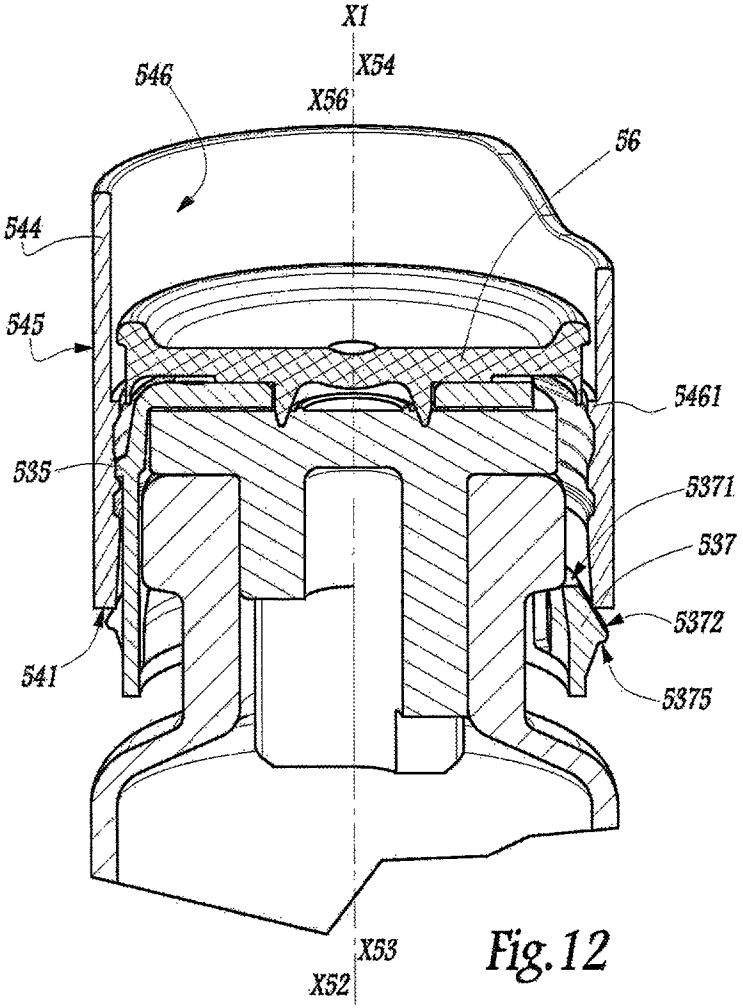

The annular part 531 comes thus in contact with the top surface 511 of the stopper 31 which stops the progression of the ring 53 in the direction of the bottom 14. The continuation of the application of force E'2 on the crown 54 of each device 50 results in displacing the rib 535 of each band 533 on the exterior of groove 5464 by elastic deformation of the bands 533, which allows the crown 54 to attain the positions of FIGS. 12 to 14 successively. This allows, in an initial instance, the edge 541 of the crown 54 to come in contact with the surfaces 5372 of the different tabs 537, as presented in FIG. 12. The continuation of this movement results in sliding the surfaces 5372 against the edge 541, which moves back the tabs 537 radially towards the axis X1, by bringing their free edges 5371 against the lower peripheral surface 132 of the neck ring 13, as presented in FIG. 13. This movement also results in the fact that the ribs 535 come in contact with the rib 5461. The top surfaces 5351 of the ribs 535, which are oriented towards the annular part 531, are in the shape of an outwardly-inclined radially-outwardly facing surface and converge towards the axis X53 by approaching the annular part 531. Thus, when the ribs 535 and 5461 come in contact by their surfaces 5351 and 5463, as presented in FIG. 13, these surfaces are in sliding contact. This allows deformation of the bands 533 elastically and progressively at the point where the ribs 535 radially move back towards the interior, i.e. in the direction of the axis X53 to pass the rib 5461 by approaching the edge 542.

Figure 14:
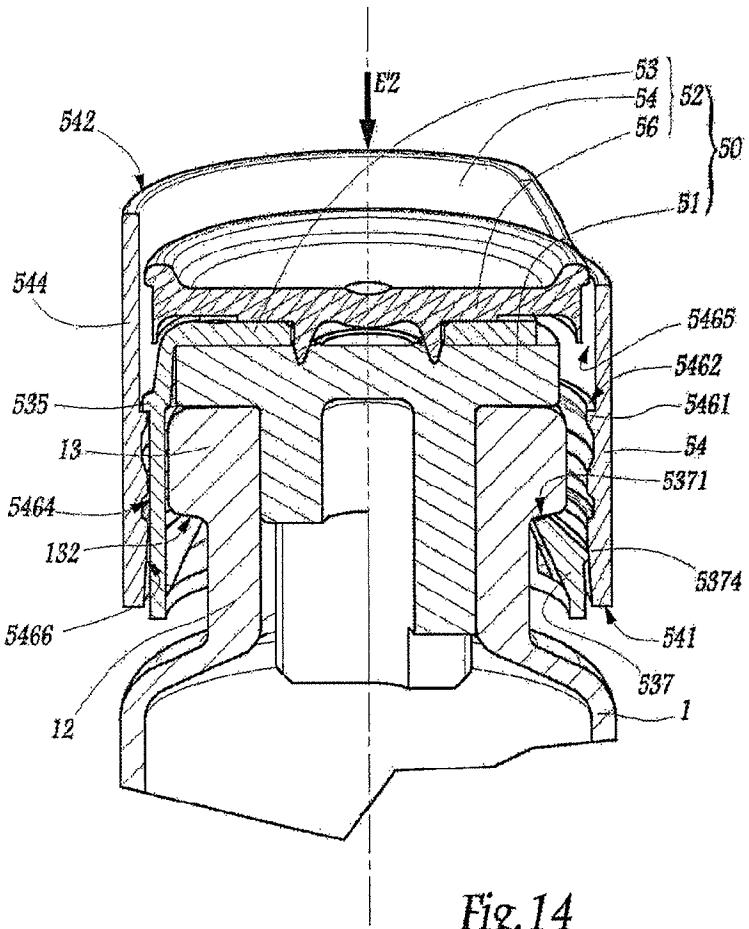

This movement continues until the configuration of FIG. 14 is attained where the ribs 535 have slid against the lower surface 5463 of the rib 5461 and have come to be locked on top of the latter, by being in support against the surface 5462 of this rib. In this respect, the lower surface 5352 of each rib 535, which is turned towards the edge 534, is perpendicular to the axis X53. Thus, in the configuration of FIG. 14, which forms a first remarkable position for the constituent elements of the cap 52, the surfaces 5352 and 5462 offer surface support and are perpendicular to the axis X1, in such a way that they efficiently oppose any travel of the ring 54 opposite the bottom 14, i.e. in a direction opposite that of the joint force E'2 applied on the crown 54. In this configuration, i.e. when the crown 54 is in its first position in relation to the ring 53, the ring 53 is efficiently retained in position in relation to a wrenching movement that has the tendency of separating from the bottom 14, due to the cooperation of the ribs 535 and 5461.

When ring 53 is in its first position of FIG. 14, device 50 is in an intermediary or non-finalized configuration in which a relative axial movement between elements 53 and 54 remains possible within the limits set by the buttress formed by the rib 5461. The continuation of the application of the individual thrust force E'2 on the edge 542 of the crown 540 results in passing this from the position of FIG. 14 to the position of FIG. 15 by sliding the radially outwardly extending protrusions 5374 of the locking tabs 537 against the surface 5466 of the skirt 544 until these radially outwardly extending protrusion 5374 move into the groove 5464, as presented in FIG. 15. In this configuration, the crown 54 is axially immobilized along the axes X52, X53, X54 and X56 which are coincident, in relation to the ring 53 due to the cooperation of the radially outwardly extending protrusions 5374 and the groove 5464.

Ideally, in terms of the action of the actuator 302, i.e. in the configuration of FIG. 5, all devices 50 should be in the configuration of FIG. 15. Nevertheless, due to a possible planar defect of the platform 303 or of the plate 301 and the manufacturing tolerances of vials 1 and devices 50, the necessary course to bring the crown 54 in the position of FIG. 15 can vary from vial 1 to another. Thus, as presented in FIG. 5, the two vials on the left on this figure can have their device 50 in the configuration of FIG. 14 while the vial on the right side has its device 50 in the configuration of FIG. 15. In other words, the course of the plate 301 is regulated so that all devices 50 that equip the different vials 1 mounted on a platform 303 reach at least the configuration of FIG. 14, starting from the configuration of FIG. 11 whereby certain ones of these can arrive at the position of FIG. 15 or in an intermediary position between those of FIGS. 14 and 15.

As the radially outwardly extending protrusion 5374 of the tabs 537 slide on the surface 5466 during the travel from the cap 54 of the position of FIG. 14 to that of FIG. 15, while the ribs 535 travel parallel to the surface 5465 without coming in contact with it, the resistant force that is endured by the crown 54 is less when the crown 54 travels from its first position to its second position in relation to the ring 53.

In the configuration of FIG. 14, the crown 54 is in its first position in which the skirt 544 ensures, through the bracing it exerts on the tabs 537, that these tabs are maintained in a configuration engaged with the surface 132 of the neck ring 13. In other words, the crown 54 forms a handling body of the ring 53, which actives the locking means formed by the tabs 537. In this position, the crown 54 can travel in the direction of the bottom 14 but cannot separate from this bottom since it is blocked by the cooperation of the ribs 535 and 5461.

In terms of lowering movement of the plate 301, it is possible to extract vials 1 of the freeze-drier 300 and to submit each in turn to a calibrated individual force E3, the magnitude of which is for instance equal to 20 Newtons. The application of this force E3 allows to slide the crown 54 in the direction of the bottom 14, i.e. approach its edge 541 of the body 16 of the vial 1, by sliding around the elements 53 and 56. This sliding movement is hardly slowed down since the single point of contact between the crown 54 and ring 53 is the support zone of the radially outwardly extending protrusion 5374 on the surface 5466, which induces a weak friction force.

Taking into account this weak friction force between the pieces 53 and 56, the force E3, which has a relatively weak magnitude, is sufficient to normally bring the ring 54 of each device 50 in the configuration of FIG. 15 or in an intermediary configuration between those of FIGS. 14 and 15 into its second position in which the radially outwardly extending protrusions (or first immobilizing means) 5374 are moved in the groove (or second immobilizing means) 5464 in such a way that the crown 54 is immobilized in translation parallel to the axis X1 in the two directions, i.e. in the same direction as the force E3 and in the inverse direction. In this position presented in FIG. 15, the crown 54 immobilizes the tabs 537 in a configuration engaged with the surface 132 of the neck ring 13.

As the force E3, which is necessary to bring the crown 54 from its position of FIG. 13 to its position of FIG. 15, is of weak intensity, it can be used to verify the proper assembly of the device 50 on the neck 12 of the vial 1. In fact, from the freeze-drier 300 it is possible to subject each vial 1 to a force E3 that is calibrated, i.e. the value of which is predetermined, and then to verify the position of the crown 54 along axis X1, after application of this force. To do so, an optical device 400 illuminates the top edge 542 of the crown 54 in the direction of the arrow F2 in FIG. 15, which makes it possible to determine the position of this crown along the axis X1. This position must be comprised in a predetermined slot that corresponds to the reception of the radially outwardly extending protrusions 5374 in the groove 5464. The slot in the direction of the arrow F2 allows to determine if the crown 54 has efficiently reached its second position.

If such is not the case, the vial 1 is identified as presenting a defect in the measure where the stopping device 50 is not correctly mounted on vial 1. This vial 1 is thus eliminated from the chain of production. In other words, the force E3 has a double function: it allows to bring all devices 50, which equip vials 1 from the freeze-drier 300 in the configuration of FIG. 15 or the crown 54 is immobilized axially in relation to the vial 1 and maintains the tabs 537 in locking configuration; this force also allows to verify the proper assembly and proper mounting of the device 50. In fact, in case of a bad assembly, this force is not sufficient to bring the cap 54 in the configuration of FIG. 15, which is detected by the device 400.

In the configuration of FIG. 15, the external edge 564 of the lid 56 is accessible laterally, in the direction of the arrow F3, through the notch 543 of the crown 54.

This allows to exercise a wrenching force E4 of the lid 56 in relation to the ring 53, to access the opening 532 and, through the latter, to the top surface 511 of the stopper 51.

A radial clearance J is defined between the edge 564 of the lid 56 and the part of surface 5465 of the skirt 544 which is located in proximity to this edge in this configuration. This clearance J allows the force E4 to effectively detach the stopper 56 from the ring 53 by breaking up the fused points that results in the merger of the platforms 563 and by extracting the skirt 562 from the opening 532. Clearance J is arranged on the main part of the periphery of the lid 56, between this lid and the edge 542. Alternatively, it can only be arranged in the vicinity of the zone of the skirt 544 opposite the notch 543 since it is in the vicinity of this zone that the lid 56 must move forward laterally towards the left side in FIG. 15.

Figure 8:
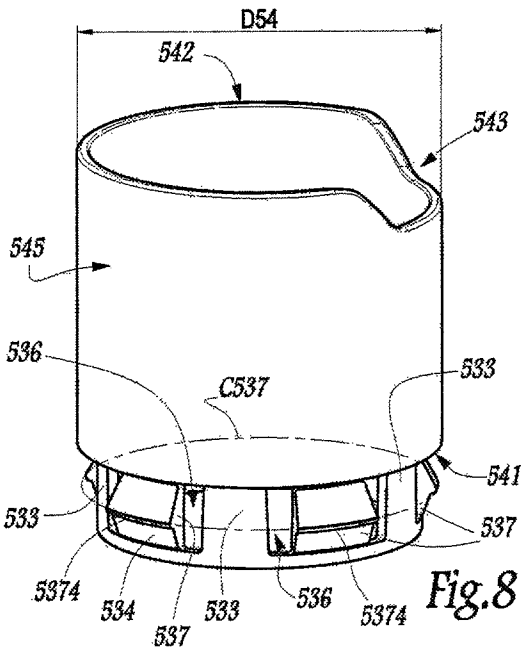
FIG. 8 is a perspective view, at a much smaller scale and an exterior view, of the cap represented in a cross-section view in FIG. 6, FIGS. 9 and 10 are exploded perspective views, according to two different angles, of the cap of FIGS. 7 and 8.
Figure 9:
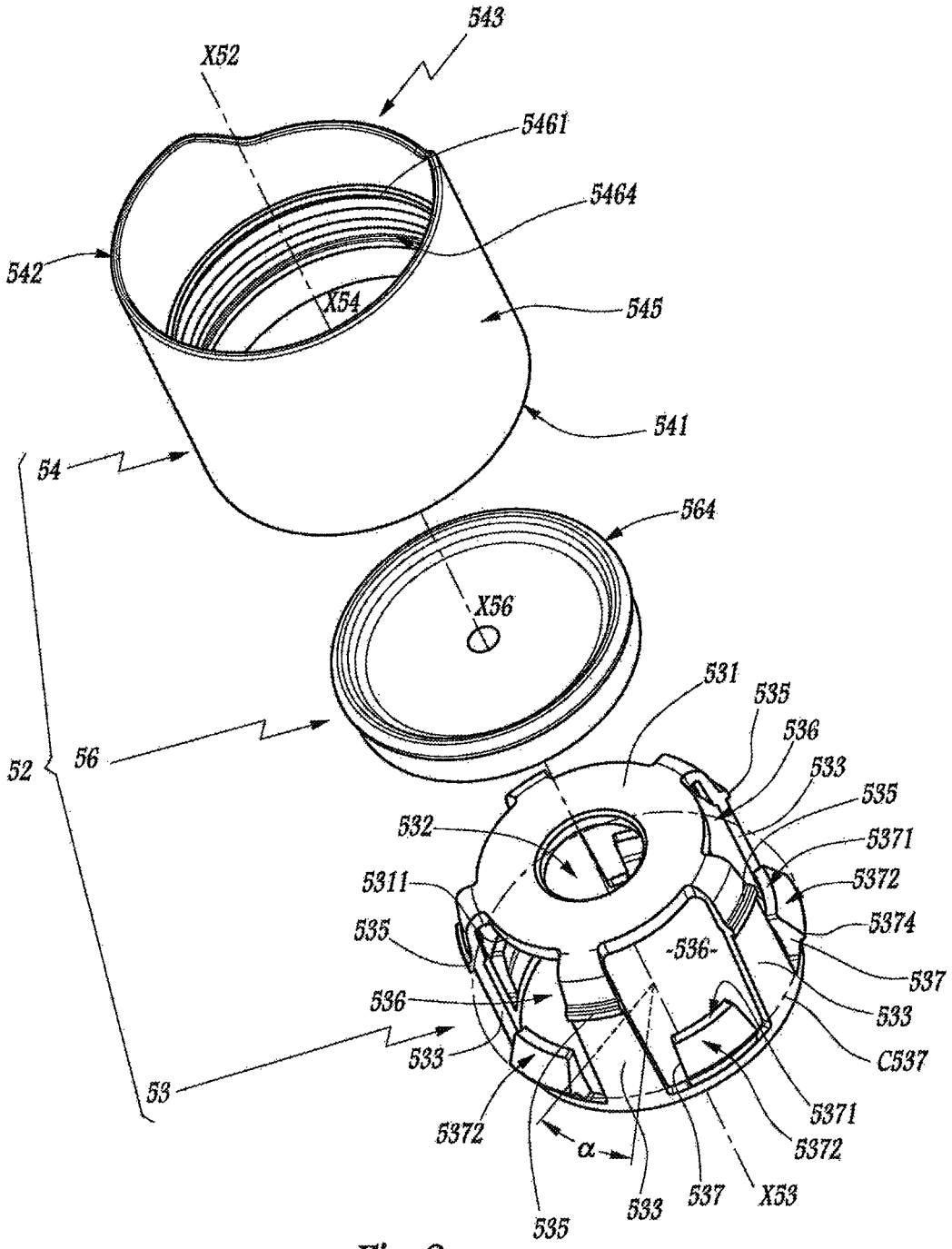
Figure 10:
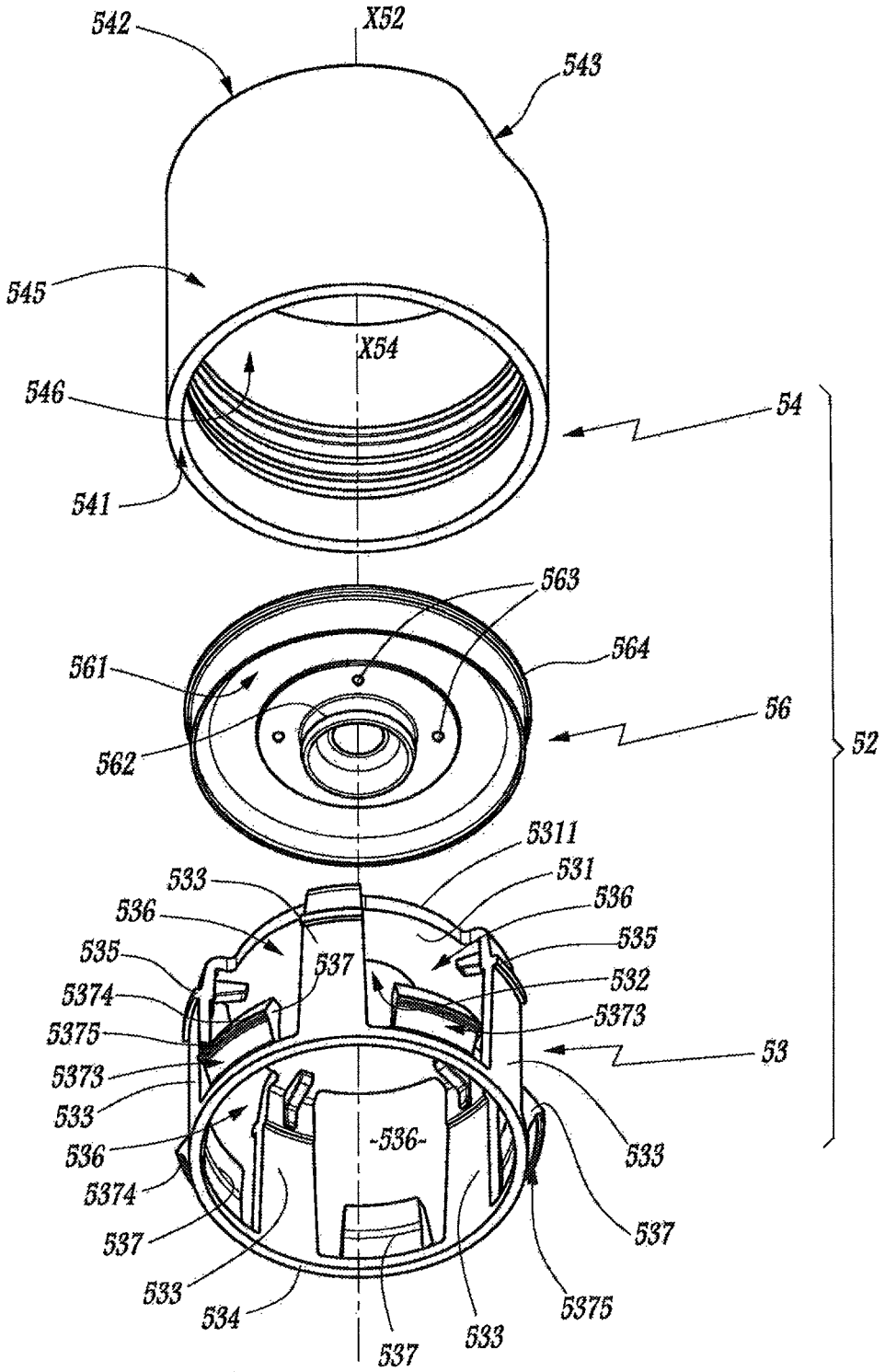

We notice in FIGS. 8 to 10 that, to the extent where the tabs 537 extend from the edge 534 and in the direction of the annular part 531 within the windows 536, they do not risk getting tangled with the tabs of the pre-assembled cap 52, i.e. mounted in the configuration of FIG. 8 which forms progress in relation to the case where the tabs extend towards the bottom starting from the edge of a ring.

The invention has been described in the case where the surface 5465 is cylindrical while the surface 5466 is in the shape of an outwardly-inclined radially-inwardly facing surface. Alternatively, the surface 5466 can be cylindrical with a circular base. According to another variable, the surface 5466 can also be slightly in the shape of an outwardly-inclined radially-inwardly facing surface with a clearance angle of a few degrees, less than 4° that aims at facilitating the release of the crown 54.

The constituent elements of cap 52 can be molded in polyoxymethylene (POM) or in an equivalent type of material.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

I claim:

1. Stopping device for a container having a neck, the stopping device comprising:

an elastomeric stopper; and a polymeric cap comprising:

a ring configured to surround the stopper and the neck of the container; and a handling body movable relative to the ring along a central longitudinal axis of the ring, wherein the ring comprises:

ring retainers which extend radially outwardly from the ring; and a locking means configured to engage the neck of the container, the locking means comprising:

locking tabs which extend upwardly from a first continuous edge of the ring, each locking tab arranged in an opening with a closed contour which crosses the ring according to a radial direction in relation to the central longitudinal axis of the ring, wherein a diameter of a circle which circumscribes the locking tabs has a value that is greater than an external diameter of the first continuous edge of the ring, and wherein the handling body comprising:

a thrust transmitting means for transmitting to the ring a thrust force applied to the handling body;

a locking activation means for activating the locking means of the ring;

a holding position retaining means which cooperates with the ring retainers to maintain the handling body in relation to the ring in a holding position;

a first cylindrical surface with a constant radius, arranged facing the ring retainers when the handling body moves between a first position in relation to the ring and a second position in relation to the ring; and a second cylindrical surface in the shape of an outwardly-inclined, radially inwardly-facing surface arranged facing the locking means of the ring when the handling body moves between the first position and the second position, wherein the handling body does not activate the locking means of the ring when the handling body is in the holding position relative to the ring, wherein the locking activation means activates the locking means of the ring and the handling body is movable in translation only in a direction of the thrust force when the handling body is in the first position relative to the ring, wherein the locking activation means activates the locking means of the ring and the handling body is immobilized in relation to the ring in axial translation, according to a direction that is parallel to the thrust force when the handling body is in the second position relative to the ring, and wherein the handling body is movable, parallel to the direction of the thrust force and in relation to the ring between the first position and the second position.

2. Device according to claim 1, wherein the handling body comprises a buttress that blocks the handling body from travelling upwardly from the first position in relation to the ring by extending radially inwardly and cooperating with the ring retainers.

3. Device according to claim 2, wherein the handling body comprises an annular skirt and the first and second surfaces and the buttress are arranged on an internal surface of the skirt.

4. Device according to claim 1, wherein the locking means and the handling body are respectively provided with first and second immobilizing means that cooperate together to immobilize in translation the handling body in relation to the ring when the handling body is in the second position.

5. Device according to claim 4, the first immobilizing means comprises at least one protrusion extending radially outwardly from each locking tab and the second immobilizing means comprises at least a groove receiving and retaining the protrusion when the handling body is in the second position.

6. Device according to claim 1, wherein the the ring retainers are placed on deformable bands that extend, in a direction that is parallel to the central longitudinal axis of the ring, between an annular part of the ring supportable by a top side of the stopper and an annular edge of the ring from which the locking means extend.

7. Device according to claim 1, wherein a lid, separate from the ring and covering a central opening in an annular part of the ring provides access to an exposed surface of the stopper, the handling body comprises an annular skirt that surrounds the stopper, the annular skirt having a notch in a top edge of the skirt a radial clearance is arranged between the lid and the top edge of the skirt, at least in a portion of the skirt diametrically opposite the notch.

8. Device according to claim 1, wherein the handling body comprises an annular skirt with a circular section that surrounds the ring radially when the handling body is in the holding position and in the first and second positions and the skirt has an exterior diameter less than 16.5 mm.

9. Container equipped with a stopping device according to claim 1.

10. Closing method for a batch of containers according to claim 9, comprising the steps of:

a) pre-assembling each stopping device with its stopper and its cap in the holding position, b) pre-mounting the devices on the necks of containers by inserting their stoppers in these necks, c) applying, by means of a pressure body, a common thrust force on all of the devices in such a way as to complete insertion of the stoppers in the necks and to bring the handling body of each stopping device in its first position, in its second position or in an intermediary position between these first and second positions, d) individually applying a calibrated thrust force on each handling body of the stopping devices in direction of travel of the handling body from its first position towards its second position, e) determining if the handling body has reached its second position at the end of the step d), and f) if the result of step e) is negative, identifying the stopping device as incorrectly mounted on the corresponding container.

11. Device according to claim 8, wherein the exterior diameter of the skirt is between 15.8 mm and 16.2 mm.

* * * * *